United States Patent [19]

Cappel et al.

[11] Patent Number: 4,572,071

[45] Date of Patent: Feb. 25, 1986

[54] DEVICE FOR GUIDING SHEETS PRINTED ON ONE OR BOTH SIDES

[75] Inventors: Bert Cappel, Muhlheim; Norbert Kreuzer, Heusenstamm, both of Fed. Rep. of Germany

[73] Assignee: M.A.N.-Roland Druckmaschinen Aktiengesellschaft, Fed. Rep. of Germany

[21] Appl. No.: 713,444

[22] Filed: Mar. 19, 1985

[30] Foreign Application Priority Data

Mar. 24, 1984 [DE] Fed. Rep. of Germany ..... 3411029

[51] Int. Cl.[4] ..... B41F 5/16; B65H 29/24

[52] U.S. Cl. ..... 101/183; 101/231; 271/195

[58] Field of Search ..... 101/183, 229, 230–232, 101/175, 177; 271/195, 194, 196, 183, 204

[56] References Cited

U.S. PATENT DOCUMENTS

| | | | |
|---|---|---|---|
| 323,394 | 8/1885 | Campbell | 271/195 |
| 3,074,712 | 1/1963 | Holt, Jr. et al. | 271/196 X |
| 3,167,006 | 1/1965 | Peyrebrune | 101/183 |
| 3,199,865 | 8/1965 | Lindemann | 271/195 |
| 3,334,897 | 8/1967 | Sharkey | 271/195 |
| 4,099,463 | 7/1978 | Zimmermann et al. | 101/230 |
| 4,168,831 | 9/1979 | Rebel | 271/195 X |
| 4,408,525 | 11/1983 | Rebel | 101/183 |
| 4,479,645 | 10/1984 | Pollich | 271/195 X |

FOREIGN PATENT DOCUMENTS

| | | | |
|---|---|---|---|
| 458158 | 12/1936 | United Kingdom | 271/195 |
| 520272 | 9/1976 | U.S.S.R. | 101/183 |

*Primary Examiner*—E. H. Eickholt

*Attorney, Agent, or Firm*—Leydig, Voit & Mayer, Ltd.

[57] ABSTRACT

A sheet guiding device for use with a multicolor printing press having multiple printing units and a sheet stacker wherein the sheet guiding means is disposed between at least one of a pair of printing units and the stacker for guiding sheets therebetween, the guiding means including a chain conveyor with sheet grippers overlying a guide surface between the printing units and the stacker with a plurality of air nozzles formed in the surface of the guide surface and communicating with a plurality of flow ducts, the guide surfaces being disposed continuously and uninterruptedly between the printing units and the sheet stacker and the air nozzles being in the form of apertures in the guide surfaces having a diameter of about 15 mm, the area of the apertures being from 15 to 30% of the total guide surface area, the apertures being supplied by low-pressure high-volume-flow fans disposed in the flow ducts and the fans being reversible so that the nozzles can be selectively supplied with air at a positive or negative pressure.

5 Claims, 3 Drawing Figures

DEVICE FOR GUIDING SHEETS PRINTED ON ONE OR BOTH SIDES

FIELD OF THE INVENTION

The present invention relates generally to a sheet guiding device for guiding sheets between units of a multicolor printing press and more particularly concerns an air assisted sheet guiding surface having air nozzles therein connected to flow ducts.

BACKGROUND OF THE INVENTION

It is known in the art to utilize a perforated surface to assist in guiding sheets along the delivery path in a printing press. A device of this general type is disclosed in M.A.N.-Roland brochure No. 43 at page 25, a copy of which is submitted herewith. German patent specification No. 1,474,214 also discloses a device for steadying flat material being guided at a constant distance from a guide surface by means of air discharged from blowing chests which extend transversely of the direction of conveyance of the material. The walls near the plane of conveyance of the material serve as guide surfaces and are formed with blowing apertures, the air being directed towards the material in streams directed in opposite pairs to one another, the air then discharging through discharge apertures in the guide surface. Unfortunately, this system of supplying and removing the flow medium is responsible for considerable additional air eddying between the flat material and the guide surface and, therefore, for considerable additional movements of the material in this zone, more particularly at the end of a printed sheet, so that the same does not receive the necessary steady guidance.

German patent specification No. 2,724,856 discloses another solution. In sheet-fed rotary presses for selective first printing and perfecting, stationary deflectors for the sheet are provided on the sheet transfer cylinders which extend over the whole width thereof and are so arranged that an air cushion forms automatically at any speed of the press. However, in practice, these deflectors cannot totally prevent the sheet from fluttering or knocking. In this respect and according to U.S. Pat. No. 2,933,039, a negative pressure can be produced, and sheet flutter thus decreased, in perfecting presses by establishing a particular association between the sheet-conveying means and deflectors below the conveyed sheet. Similarly, according to German utility model No. 7,128,485 suction chambers can be disposed in parts at critical places of the sheet-conveying path in order to maintain the sheet in engagement with the guide surfaces, for instance, at reversal stations.

OBJECTS AND SUMMARY OF THE INVENTION

The primary aim of the present invention is to provide optimal guidance of a printed sheet at very high press speeds and with a very reduced weight of paper. To this end, means are provided for steadying printing sheets being guided along a guide surface by means of a gaseous flow agent. The guide surface is disposed immediately below and along a sheet-guiding path having a chain and grippers and the guide surface is formed with apertures communicating with a plurality of flow ducts. Each has at least two fans which can be selectively brought into operation and which are steplessly variable. When suction is being applied the printed sheets slide steadily over the guide surface. Conversely, in positive-pressure (blowing) operation, a sufficient volume of air in such an optimal distribution is discharged from the apertures in the flow ducts so that the printed sheet dries while its free end is simultaneously firmly guided.

In the preferred embodiments, reversible fans are used or else a combination of blowing fans and suction fans are provided, so that the pressure operative on the guide surface can be varied within wide limits. Depending on whether ink is applied to one or both sides of the sheet and depending further on the nature of the ink and stock used, a substantial or a small air cushion or a reduced or a considerable negative pressure can be produced on the guide surface. In special cases some zones can be at a negative pressure and others at a positive pressure.

The guide surface is disposed preferably parallel to the sheet-conveying path. Distributing the blowing apertures in the guide surface in the manner described later herein ensures that the flow medium impinges on the sheet at an optimal speed. Also, in blowing operation guidance of the sheet is combined with drying thereof. Because of the large volume throughput of air flow, the high press speeds which are now conventional can be used in suction operation and blowing operation with optimal sheet guidance.

According to another feature of the invention, each flow duct has a plurality of fans, the two inner fans blowing and the two outer fans sucking. The four-fan arrangement is very advantageous for evening out the air flow and the two inner fans of the duct provide optimal distribution of the flow medium. Furthermore, if the volume flow of the flow medium produced by the two fans on blowing operation is inadequate, the suction fans can be reversed or have their electrical polarity reversed to provide additional blowing air flow. Also, the guide surface can be subdivided into a plurality of ducts with each discrete duct being steplessly variable by means of the fans. In practice a six-duct arrangement has proved to be optimal for sheet guiding even in curved regions.

Pursuant to a more detailed aspect of the invention, the apertures are distributed substantially uniformly in the substantially straight regions of the guide surface but irregularly in the curved regions of the guide surface. More specifically the apertures are so distributed in the curved regions as to be absent immediately before the crest of the guide surface. Consequently, in a curved region the kinetic energy of the end of the sheet is not increased with kinetic energy from the pressure medium in the pressing operation. Preferably the fans of any of the flow ducts are controllable steplessly by means of separate controllers disposed adjacent the stacker of the press.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1:
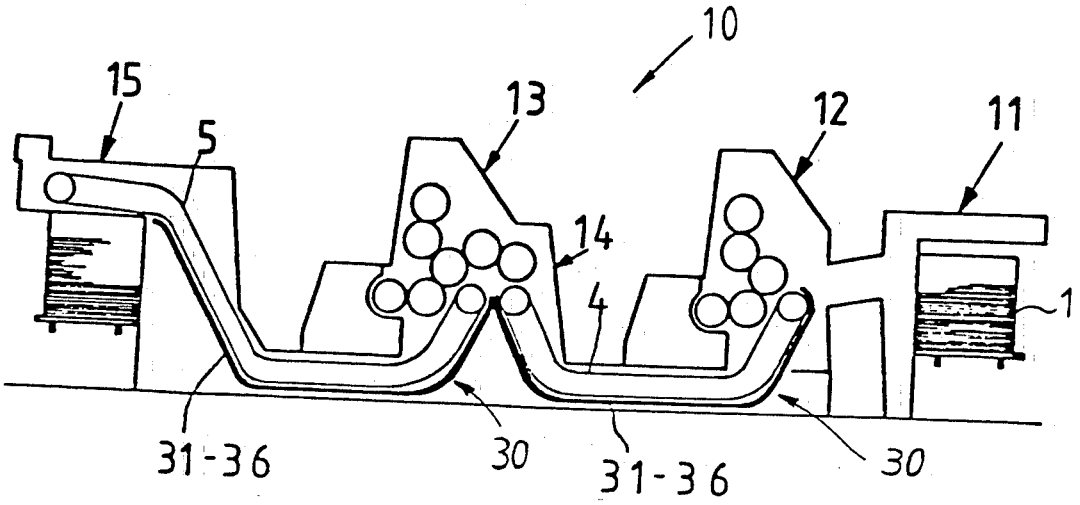
FIG. 1 is a schematic side elevation of a multicolor printing press employing the novel guiding means of the present invention between a plurality of press units and the sheet stacker.
Figure 2:
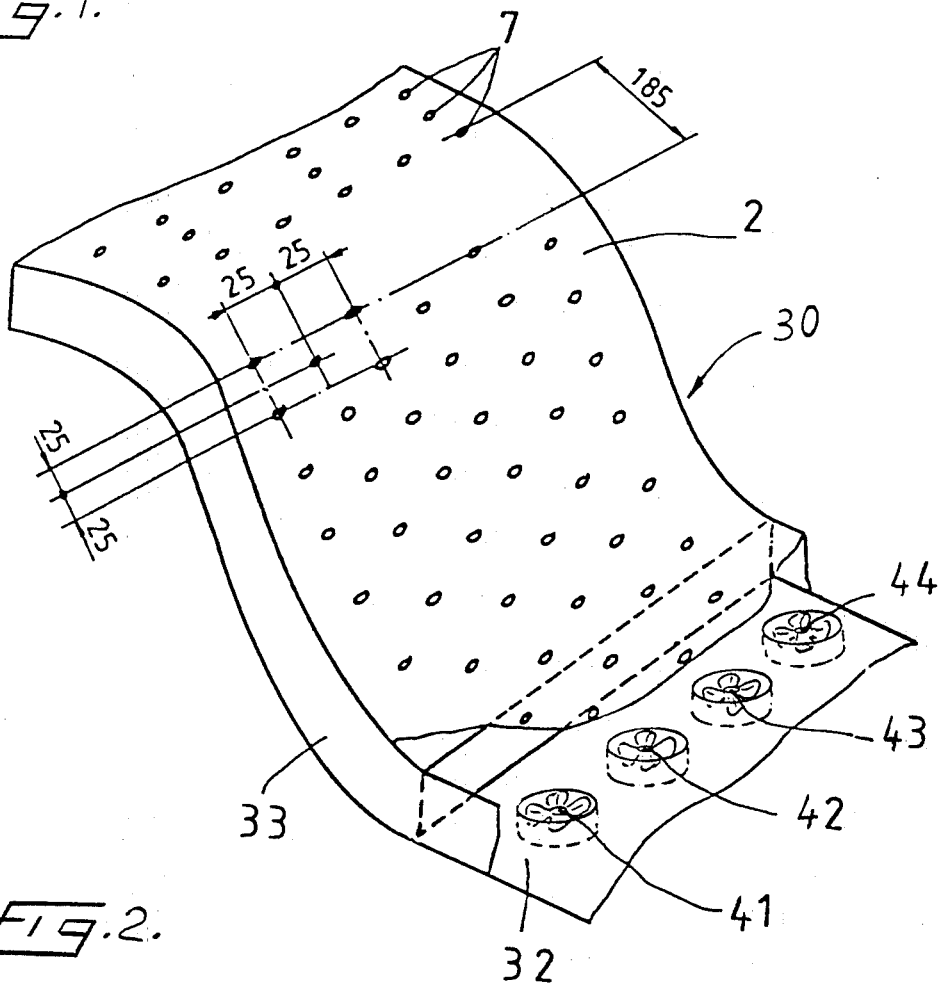
FIG. 2 is a greatly enlarged, partial perspective view of a part of the guide surface and air duct arrangement of FIG. 1.
Figure 3:
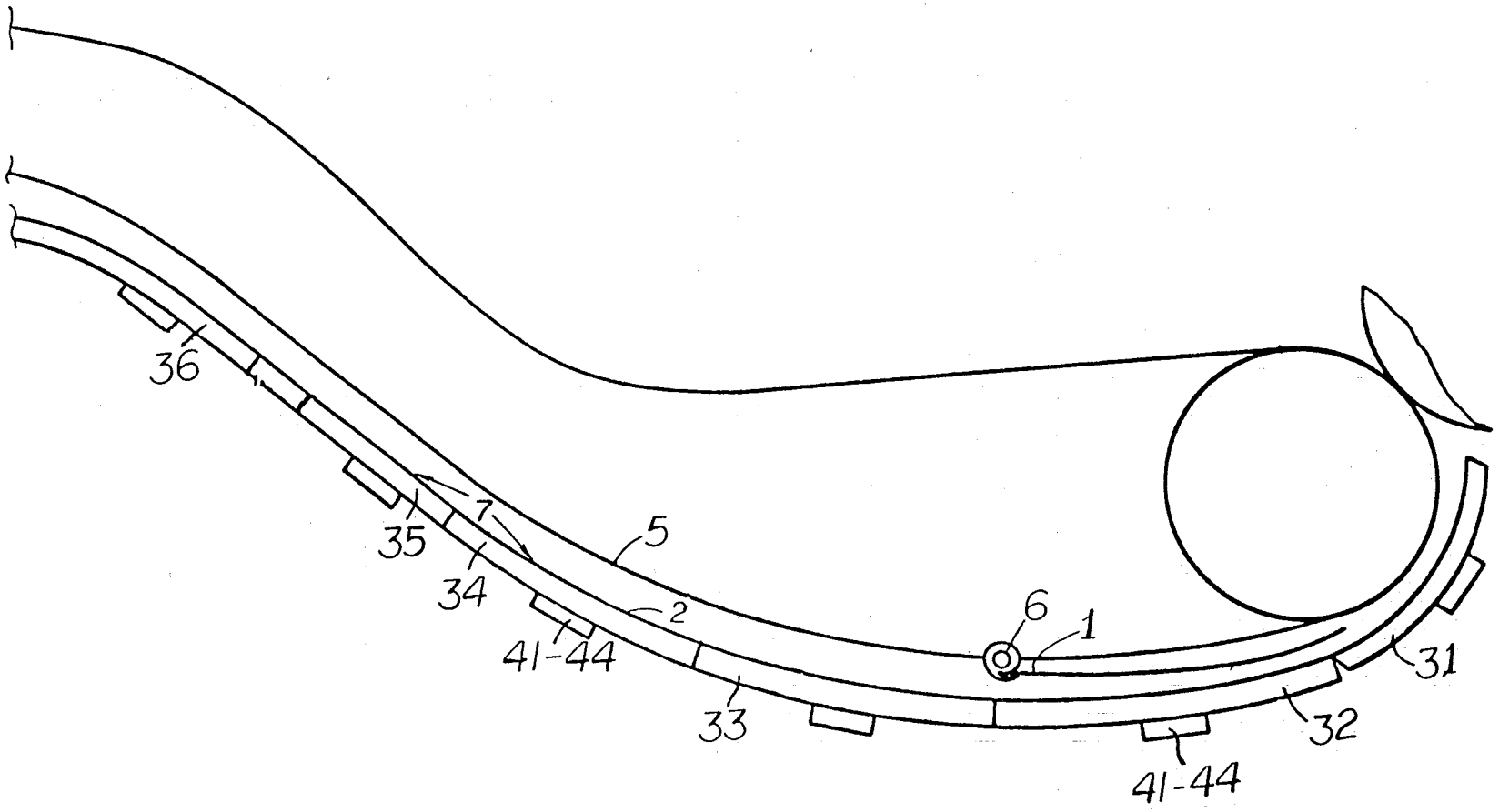
FIG. 3 is an enlarged, fragmentary side elevation, in schematic form, of a portion of the guiding means of FIG. 1.

Turning now to the drawings, there is shown in FIG. 1, a multicolor printing press indicated generally at 10.

Sheets 1 from a feeder 11 are supplied to a first printing unit 12, are printed thereby, and then supplied to a second printing unit 13. Preferably, a sheet-turning station 14 precedes the second unit 13 so the sheets 1 can be turned in the station 14 and then perfected in the second unit 13. Alternatively, the sheets 1 can be applied to the second press 13 unturned for two-color printing. In any case the sheets 1 which have passed through the second printing unit 13 go to the sheet stacker 15. The sheets are conveyed between the units 12 and 13 and the sheet stacker 15 by chain conveyors 4, 5 which have grippers 6.

In accordance with the present invention, the sheets 1 are guided on a surface 2 which forms the top of an air flow duct, indicated generally at 30 which has a plurality of separate duct chambers 31–36. The guide surface 2 is disposed immediately below and along a sheet-guiding path defined by the chain conveyors 4, 5 and grippers 6.

Pursuant to the invention, the guide surface 2 is formed with a plurality of apertures in a variety of preselected distributions to provide a positive or negative air flow for steadying the sheets 1. To this end, each such duct 31–36 has a plurality of fans 41–44 which can be selectively brought into operation and which are steplessly variable. When suction is being applied, the printed sheets 1 slide steadily over the guide surface 2. Conversely, in positive-pressure (blowing) operation, a sufficient volume of air in such an optimal distribution is discharged from the aperture in the flow ducts 31–36 that the printed sheet dries while its free end is simultaneously firmly guided.

In the illustrated embodiment, the fans 41–44 are disposed in outlets, one beside the other in the bottom wall of each of the duct sections 31–36. Preferably the inner fans 42 and 43 are positive blowing fans and the outer fans 41 and 44 are suction fans. The four-fan arrangement has proved very advantageous for evening out the air flow. The two inner fans 42, 43 of each duct 31–36 provide an optimal distribution of the air flow. If the volume flow of the air flow profuced by the two fans 42, 43 on blowing operation is inadequate, the suction fans 41, 44 can be reversed or have their electrical polarity reversed to provide additional positive air flow.

As shown in the illustrated embodiment, the guide surface 2 can be subdivided into approximately six fan ducts 31–36 with each discrete duct being capable of providing a steplessly variable air flow by means of the fans 41–44. This six-duct arrangement has proven to be an optimal arrangement for sheet guiding even in curved regions. As noted above, the guide surface 2 is formed with apertures 7 which are about 15 mm. in diameter. Preferably the apertures 7 are distributed substantially uniformly in the substantially straight regions of the guide surface 2 but are irregularly distributed in the curved regions of the guide surfaces. More particularly, the apertures 7 are distributed in the curved regions so as to be absent immediately before the crest of the guide surface. Consequently, in a curved region the kinetic energy of the end of the sheet is not increased with kinetic energy from the pressure medium in the pressing operation.

In keeping with a further aspect of the invention, the fans 41–44 of any flow duct 31–36 are controllable steplessly by means of separate controllers disposed adjacent the stacker 15 of a press 10. The press operator can therefore, while standing directly at the delivery station, vary the different flow ducts 31–36 while the press is running so that blowing regions of different intensities can be produced in accordance with sheet weight. A sheet which might otherwise have been smeared on the guide surface 2 can be so adjusted during further printing that the normal contact place is altered and the sheet 1 can thus pass along the entire guide surface in the press without smearing. The gentle flow incidence hereinbefore mentioned and the optimum distribution of the apertures 7 in the curved regions further facilitates passage of the sheets through the press without smearing.

For nominal operation, the flow of air over the complete guide surface 2 has a discharge volume flow of about 200 $m^3$/hr. at a pressure of approximately 80 pascals. It will be understood, of course, that these quantity specifications have proved optimal for average printed sheet weights. In the particular arrangement shown in FIG. 1, the guide surface 2 is disposed between a transfer cylinder and a stacker 15 or delivery station and also between two transfer cylinders in the press 10. These two different regions have proved optimal for braking or intercepting the printed sheet. As an example, a positive 4/0 pressure in first printing and perfecting presses has been found satisfactory. On the other hand to provide an air cushion between guide surface 2 and a sheet 1 printed on the back side a 2/2 pressure as proved optimal for preventing smearing of the printed sheet.

From the foregoing, it will be seen that the air assisted guiding means of the present invention provides a very simple yet effective means for positively transporting and controlling sheets between press units which aid in drying and preventing smearing of the freshly printed sheets. By dividing the duct 30 into a plurality of units 31–36 each with selectively controlled fans 41–44, extremely precise control of sheet transport can be achieved over a wide range of press speeds and paper weights.

We claim as our invention:

1. For use with a multicolor printing press having multiple printing units and a sheet stacker, a sheet guiding means disposed between at least one of a pair of said units and one of said units and said stacker for guiding sheets therebetween, said guiding means including a chain conveyor with sheet grippers overlying a guide surface between said units in said stacker with a plurality of air nozzles formed in the surface of said guide surface and communicating with a plurality of flow ducts, characterized in that the guide surfaces are disposed continuously and uninterruptedly between said printing units and said sheet stacker and the air nozzles take the form of apertures in the guide surfaces having a diameter of about 15 mm, the area of the apertures being from 15 to 30% of the total guide surface area, the apertures being supplied by low-pressure high-volume-flow fans disposed in the flow ducts and in that the fans are reversible so that the nozzles can be selectively supplied with air at a positive or negative pressure.

2. A device according to claim 1 further characterized in that the guide surface is subdivided into a plurality of flow ducts and the air flow of each discrete flow duct is adjustable independently.

3. A device according to claim 2, further characterized in that four fans are associated with each flow duct and, upon selective actuation, the two outer fans draw a vacuum and the two inner fans blow positively.

4. A device according to claim 1 further characterized in that the apertures in the substantially straight regions of the guide surface are distributed substantially uniformly and the apertures in the curved regions are distributed nonuniformly so as to be absent immediately before the crests of the guide surface.

5. A device according to claim 1, characterized in that the flow medium of the complete guide surface has a positive volume flow of approximately 1200 $m^3$/hr. at a pressure of approximately 80 pascals.

* * * * *